US005553685A

United States Patent [19]

Cook

[11] Patent Number: 5,553,685

[45] Date of Patent: Sep. 10, 1996

[54] ROOF SAFETY ANCHOR

[76] Inventor: Alan R. Cook, 7005 Trappers Ct., Manassas, Va. 22111

[21] Appl. No.: 365,018

[22] Filed: Dec. 28, 1994

[51] Int. Cl.[6] ..... A62B 35/00

[52] U.S. Cl. ..... 182/45; 182/3

[58] Field of Search ..... 182/3, 45; 248/237; 52/702

[56] References Cited

U.S. PATENT DOCUMENTS

| | | | |
|---|---|---|---|
| 3,217,833 | 6/1964 | Smith . | |
| 3,269,679 | 8/1966 | Grappo | 248/237 X |
| 3,425,509 | 2/1969 | Gilbert | 182/113 |
| 4,249,713 | 2/1981 | Glynn et al. . | |
| 5,143,171 | 9/1992 | Glynn et al. . | |
| 5,248,021 | 9/1993 | Nichols | 182/3 |
| 5,370,202 | 12/1994 | Nichols . | |

FOREIGN PATENT DOCUMENTS

| | | | |
|---|---|---|---|
| 479629 | 12/1951 | Canada | 182/45 |
| 2219826 | 12/1989 | United Kingdom . | |

*Primary Examiner*—Alvin C. Chin-Shue
*Attorney, Agent, or Firm*—Richard C. Litman

[57] ABSTRACT

The present invention relates to a personal fall-arrest safety anchor of a unitary form, including a hoop portion for encircling a standard dimensioned rafter and an apertured tab portion for attachment of a lifeline. The hoop portion includes two parallel vertical members and a bridging web unitarily connecting the lower ends of the vertical members. The bridging web prevents pullout of the anchor in the direction of forces exerted by a lifeline. The bridging web further allows a bracing or wedging member to be inserted between the bottom of the rafter and the bridging web, which act both as a locking wedge and additional load bearing support for the rafter. An independent overlapping plate installed over the vertical members of the anchor reduces the chances of fastener pull-out by a torque or shearing force upon fasteners. A preformed elastomeric flashing with a frusto-pyramidal apertured member is installed over the tab portion for weather-proofing the anchor.

11 Claims, 6 Drawing Sheets

ROOF SAFETY ANCHOR

BACKGROUND OF THE INVENTION

1. Field of the Invention

The present invention relates to a personal fall-arrest safety anchor which is permanently attached to and encircles a roof rafter. A preformed elastomeric flashing for weather-proofing, an overlapping bracing bar, and mounting devices to enhance safety of the anchor are also described.

2. Description of the Prior Art

Government regulations require fall prevention systems for roofers or others working on a roof. Certain fall restraint systems of the anchor type described herein currently are required by regulation to have a minimum load strength of 5400 pounds. Yet these requirements are meaningless if the anchor cannot be safely installed. To be safely installed, placement of the device on a properly installed roof rafter of appropriate dimension and load carrying capability is obviously and minimally required.

However, for building economy, today's roofing joists typically come pre-framed in "A"-type braces, often constructed of 2"×4" lumber. Use of such preassembled roof trusses requires strict adherence by the builder to the manufacturer's engineering specifications and limitations. For example, many manufacturers do not allow drilling of any holes through the truss rafters, which severely limits the design of retrofit roof anchors.

The prior art shows roof anchors capable being installed onto pitched roofs and rafters of variable size. These anchors teach the use of members extending generally downwardly to embrace various roof elements, usually rafters. However, in order to accomplish their intended purpose and create both an operable and safe anchor installation, each of these devices requires the use of fasteners, usually nails or a threaded bolt of appropriate dimension, in order to secure the device to the roof structure. However, in the event of fastener failure or improper installation, e.g. bolt shearing, mechanical stripping of the bolt thread, nails pulling from weak lumber, or failing to install the fastener entirely, none of the devices found in the prior art would be capable of preventing a fall. The present invention discloses fail-safe features to allow an anchor to fulfill its intended purpose should fasteners fail, by a means of encircling a rafter or a preassembled truss.

U.S. Pat No. 5,370,202 issued Dec. 6, 1994 to Nichols discloses a fall arrest lifeline roof anchor, as does a prior patent issued to Nichols on Sep. 28, 1993 (U.S. Pat No. 5,248,021). A primary embodiment in each patent is shown as a bracket having flat parallel legs, further having preformed nail and bolt holes, for embracing a rafter, and, an apertured upwardly projecting central portion for connection of a standard snap hook or carabiner to which a lifeline can be attached. In the absence of fasteners; little force needs to be applied to the carabiner in order to slip the legs of the anchor off the rafter. Furthermore, any forces applied to the device are transmitted to the fasteners, rather than the legs of the device itself, increasing the chance of failure.

A second embodiment of the Nichols patents illustrate that the bottom free-end portions of the legs can be bent inward underneath the bottom of the rafter alleging greater strength and resistance to twisting or swinging movement of the bracket relative to the rafter. However, after spreading the legs sufficiently for installation over the rafter, any loss of resiliency in the material from which the anchor is made will cause the legs to stay spread, adding unwanted tension and shearing forces against the fasteners. Loss of resiliency and the fastener would then result in loss of the minimal advantage gained by bending the legs of the anchor inward by allowing the legs to slip by the rafter.

U.S. Pat. No. 5,143,171 issued Sep. 1, 1992 to Glynn et al. discloses a lifeline safety system for a pitched roof which employs a "J"-shaped bolt to secure the bracket assembly to the roof. A nut with a pair of arms is used to torque the nut to the bolt beneath a rafter. U.S. Pat. No. 4,249,713 issued Feb. 10, 1981 to Glynn et al. discloses a roof peak metal strap with outwardly extending legs to be attached to roof joists. A central portion of the strap extends upwardly at the roof peak to which a safety line may be attached.

U.S. Pat. No. 3,217,833 issued on Jun. 29, 1964 to Smith shows a sliding safety anchor for use with steel rails. U.K Pat. Application No. 2219826 by applicant Campbell published Dec. 20, 1989 shows a multiple part anchoring system comprising a clamp attached to an underlying beam and a shaft which interconnects with at least one extension of the clamp. The shaft which extends through the external covering of the roof is provided with an eyelet to which to attach a harness.

However, none of the above patents disclose a unitary means of encircling a joist so as to provide a fail-safe means of anchoring a fall-arrest lifeline. Furthermore, manufacturers' engineering requirements for pre-assembled 2"×4" brace-member trusses often prohibit the drilling of holes into the 2"×4" brace members, which may cause weakening of the truss and an inability to carry its load requirements. Hence, anchors which disclose the use of large diameter fasteners passing through the lumber would result in a safety hazard. Less secure fastening means such as nails or screws would be necessary. Furthermore, none of the above referenced patents disclose an independent overlapping plate to reduce the chances of fastener pull-out by a torque or force upon the anchor.

Finally, none of the above referenced patents disclose a flashing preformed to an anchor for weather-proofing a roof. Water damage to a roof joist member would further the chances of an anchor's fastening means being loosened or damaged.

None of the above referenced inventions and patents, taken either singly or in combination, is seen to describe the instant invention as claimed.

SUMMARY OF THE INVENTION

The present invention relates to a personal fall-arrest safety anchoring device which may be installed into the roof rafters of lumber framed buildings. In the preferred embodiment of the present invention, an anchor is provided for encircling a rafter, which anchor is of a unitary form including a hoop portion, shaped from a single metal strap so as to closely encircle a standard rafter, and, an apertured tab portion for attachment of a lifeline.

The hoop portion includes two parallel vertical members and a bridging web unitarily connecting the said lower ends of the vertical members. The anchor may be sized to conform to the dimensions of any lumber suitable for framing of roofs. The hoop portion may be slipped over the ends of lumber of appropriate dimension before construction.

Regardless of the relative dimensions between the hoop portion and the rafter, the bridging web prevents pullout of the anchor in the direction of forces exerted by a lifeline, and, eliminates any twisting motion of the vertical members.

If lumber of dimensions equal to that of the hoop portion is used, the bridging web further allows the hoop portion to frictionally engage the bottom and sides of the rafter. In situations where 2"×4" rafter trusses are used, frictional engagement of the bottom of a rafter is accomplished by addition of a steel bracing or wedging member of appropriate dimension. The bracing or wedging member is inserted between the bottom of the rafter and the bridging web, acting both as a locking wedge and additional load bearing support for the rafter.

The hoop portion has preformed tacking apertures for convenient securing of vertical members and bracing members to a rafter resulting in the least possible disturbance of the integrity of a rafter. Larger registered mounting apertures are provided for a bolt or pin extending transversely through the vertical members of the hoop, which may either pass through a wedging member to secure it between the rafter and the bridging web, or pass immediately beneath the rafter. The use of a bracing member eliminates use of the mounting apertures entirely by engaging the bridging web and tensioning the anchor from below the rafter. The bracing member is fastened to the bottom of the rafter through tacking apertures.

The tab portion includes a pair of parallel members which may be pliantly separated so as to allow sufficient space for passage of the hoop over pre-assembled lumber. The anchor is preferably fabricated from cold-rolled steel which maintains a resiliency which allows the parallel members to return to nearly their original position. However, unlike the prior art devices, loss of resiliency does not affect the ability of the bridging member to prevent pull-out of the anchor from its rafter.

The tab portion projects through the sheathing of the roof. An aperture in the tab are provided for connection of a standard snap hook or carabiner to which a lifeline can be attached. Additional registered openings in the tab provide a means of securing the parallel members of the tab portion together.

An independent overlapping roughly rectangular metal plate is further provided to reduce the chances of fastener pull-out by a torque upon the anchor or shearing force upon fasteners passing through the vertical members of the hoop portion. A center portion of the plate overlaps the vertical member of the hoop portion so as to cover the heads of fasteners. The plate is shaped to take into account the thickness of the vertical member whereby an extending portion of the plate lies flat against the rafter beyond the edge of the vertical member of the hoop portion. The extending portion is independently fastened to the rafter by fastening means passing through preformed tacking apertures in the plate. The extending portion of the plate and the edge of the vertical member may abut, which further acts as a stop against said shearing forces.

A generally rectangular preformed elastomeric flashing with a frusto-pyramidal apertured member is installed over the tab portion for weather-proofing purposes. Water damage to a roof joist member can increase the chances of an anchor's fastening means coming loose. The flashing seals by resilient contact of the frusto-pyramidal member's edges with the tab portion, and may be adhered to the roof and anchor with suitable roofing cement.

Accordingly, it is an object of the present invention to provide an anchoring means for a safety lifeline which allows a roofer to be tethered to the anchor safely, and which meets some of the more stringent government regulations.

It is another object of the present invention to provide an anchoring means which can be installed conveniently and quickly in standard roof construction while meeting manufacturers engineering requirements, particularly in roof trusses engineered with construction limitations.

It is a further object of the present invention to provide an anchoring means which remains functional after roofing has been completed and improves safety regardless of fastener failure or inadequate fastener installation.

Still another object of the present invention is to provide an anchoring means with independent but interacting features which provide a means of weather-proofing the underlying anchor support and a means of bracing, wedging or overlapping the anchor for increased safety.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
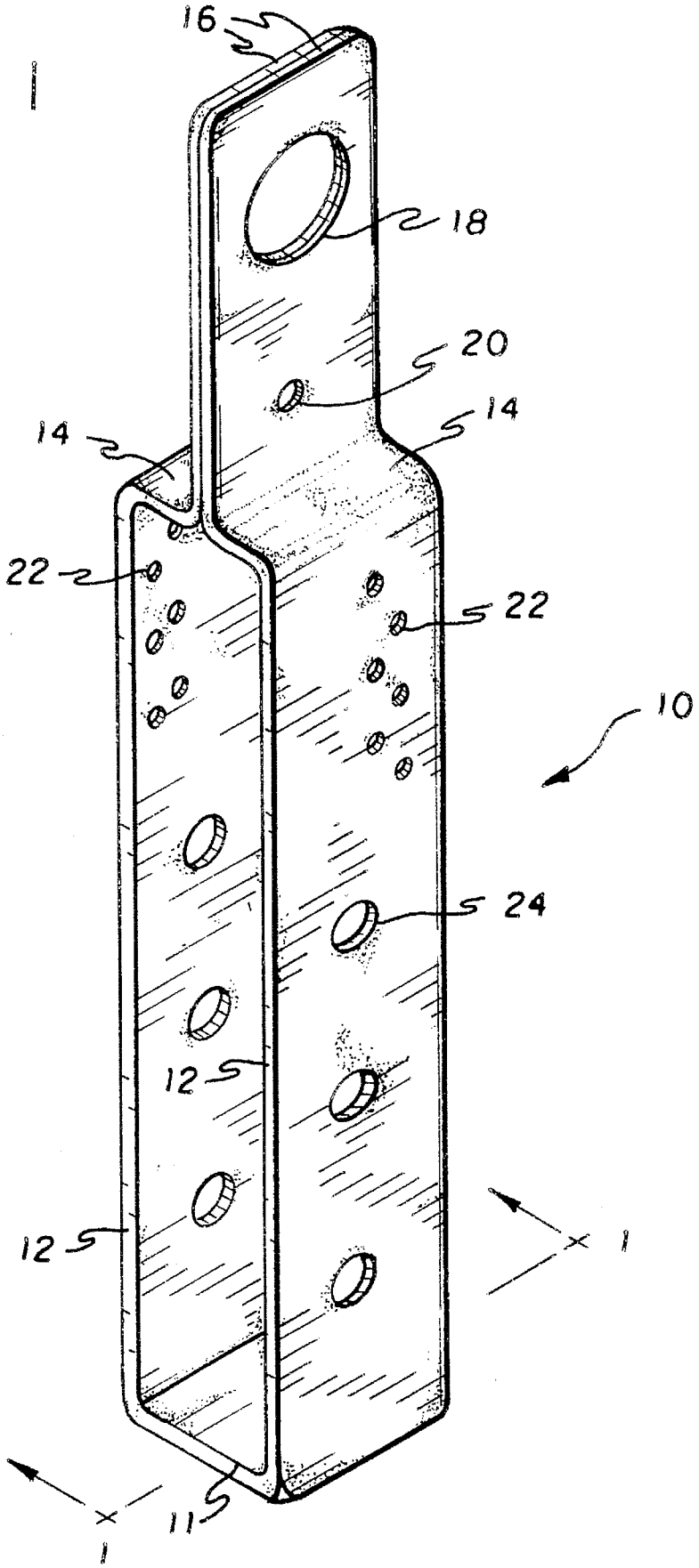
FIG. 1 is a perspective view of the anchor.
Figure 2:
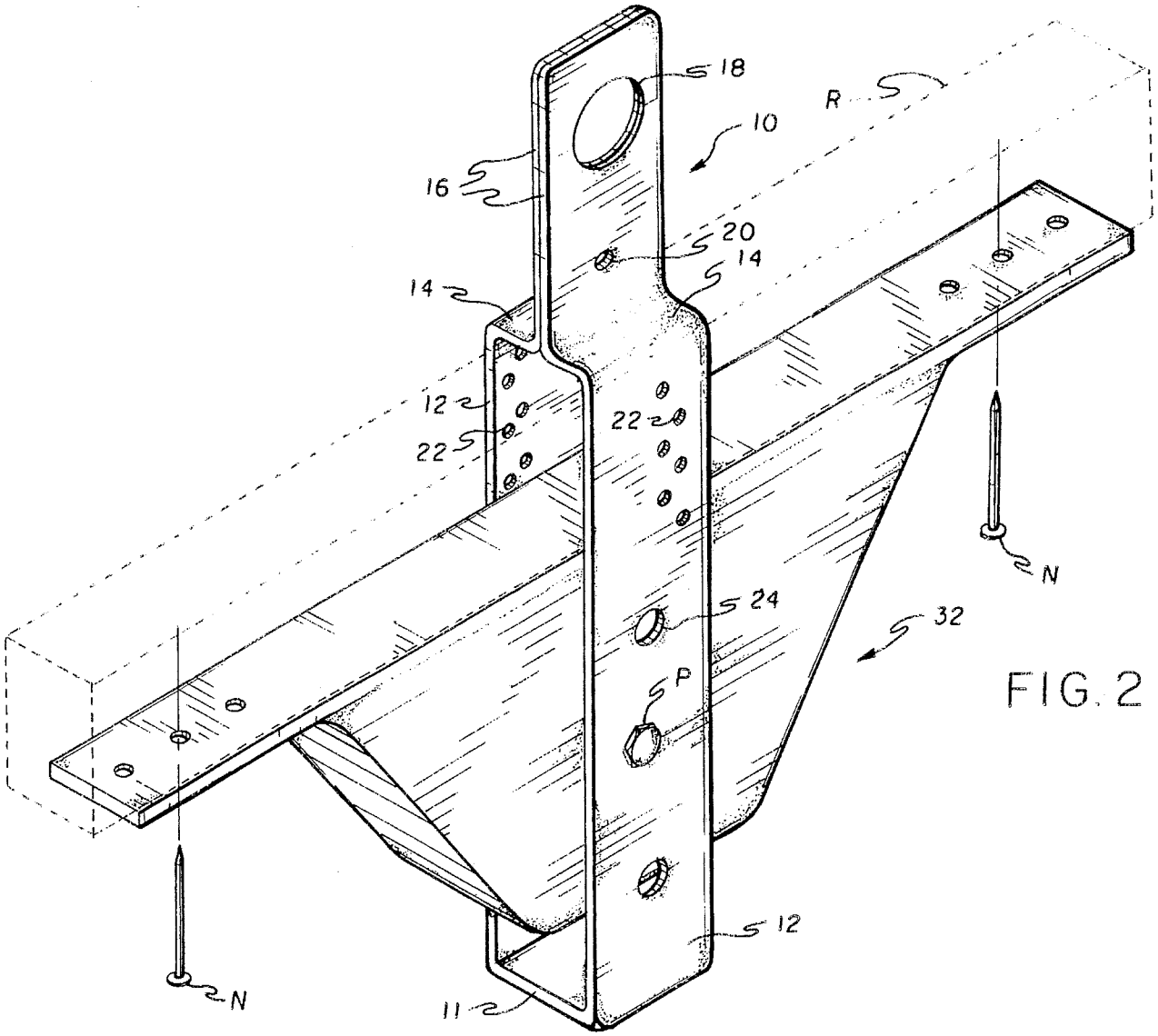
FIG. 2 is a perspective view of the anchor, as shown in FIG. 1, with a wedge.

In the preferred embodiment of the present invention and referring to FIG. 1 of the drawings, a roof safety anchor 10 is shown in the form of a shaped strap of rolled steel. At each of a pair of points equidistant from the center of the strap, as shown by reference line 1—1, the strap bends perpendicularly upward, defining a bridging member 11. The strap further forms a pair of vertical members 12. These vertical members 12 run contiguously with the surface of a rafter (as shown in FIG. 2). At the upper end of each of the vertical members, an inward bend forms a shoulder 14. Each shoulder 14 runs inwardly perpendicular to each of the vertical members 12 defining a hoop portion. A next upward bend in the shoulders 14 causes the surfaces of the strap to run in substantially contiguous engagement upward from the shoulder, so forming a pair of parallel members 16. Each end at the same point, together forming a tab portion.

An aperture 18 is provided in the tab portion for attachment of a lifeline. Registered openings 20 are provided within the tab portion whereby each of the parallel members 16 can be secured together. Groups of tacking apertures 22 for passage of fasteners are offset so as to avoid interference of fasteners with one another installed into the rafter from opposite sides. A second group of mounting apertures 24 allows the passage of fasteners, such as bolts or pins, through each of the vertical members and corresponding wedging member 32 (as shown in FIGS. 2, 3 and 4.)

In construction where 2"×4" rafter trusses are used, manufacturer's engineering specifications may require that no holes be drilled through the 2"×4" members. Although the anchor 10 can be manufactured and specifically sized to exactly fit any standard dimension lumber, FIG. 2 illustrates that a single size anchor may be used with smaller dimensioned rafters while maintaining the added safety provided by the present invention's unitary anchor design. The anchor 10 is shown installed upon a 2"×4" rafter R, found in typical pre-fabricated roof trusses, using a wedging member 32 wedged below the rafter R. The wedging member 32 is held in place by a pin P passing through a mounting aperture 24. The wedging member serves to not only to secure the anchor 10 to the rafter, but also distributes any forces over a greater area of the rafter R. Such distribution assists in withstanding forces which approach the minimum load of 5400 pounds required by government regulations for roof safety anchors of the type described herein, lends strength to the rafter, and, minimizes shearing forces.

A clip or carabiner may be installed into the aperture 18. Should the block, bolt and other fasteners fail to be installed or otherwise fail after installation, the safety anchor is still operational with the clip in place because the clip itself acts as an additional fail-safe preventing the anchor from pulling apart. This practically eliminates the need for a fastener through a registered opening 28 to prevent separation of the parallel members 16 of the anchor 10 from the rafter. Nails N or screws may be used to tack the anchor or wedge to the rafter. However, even in the absence of fasteners, the present invention itself can still arrest a fall, and without weakening of the truss through installation of bolts passing through the rafter member. The present invention can pull or fall out only if the structural framing member itself fails or pulls away from the truss.

Figure 3:
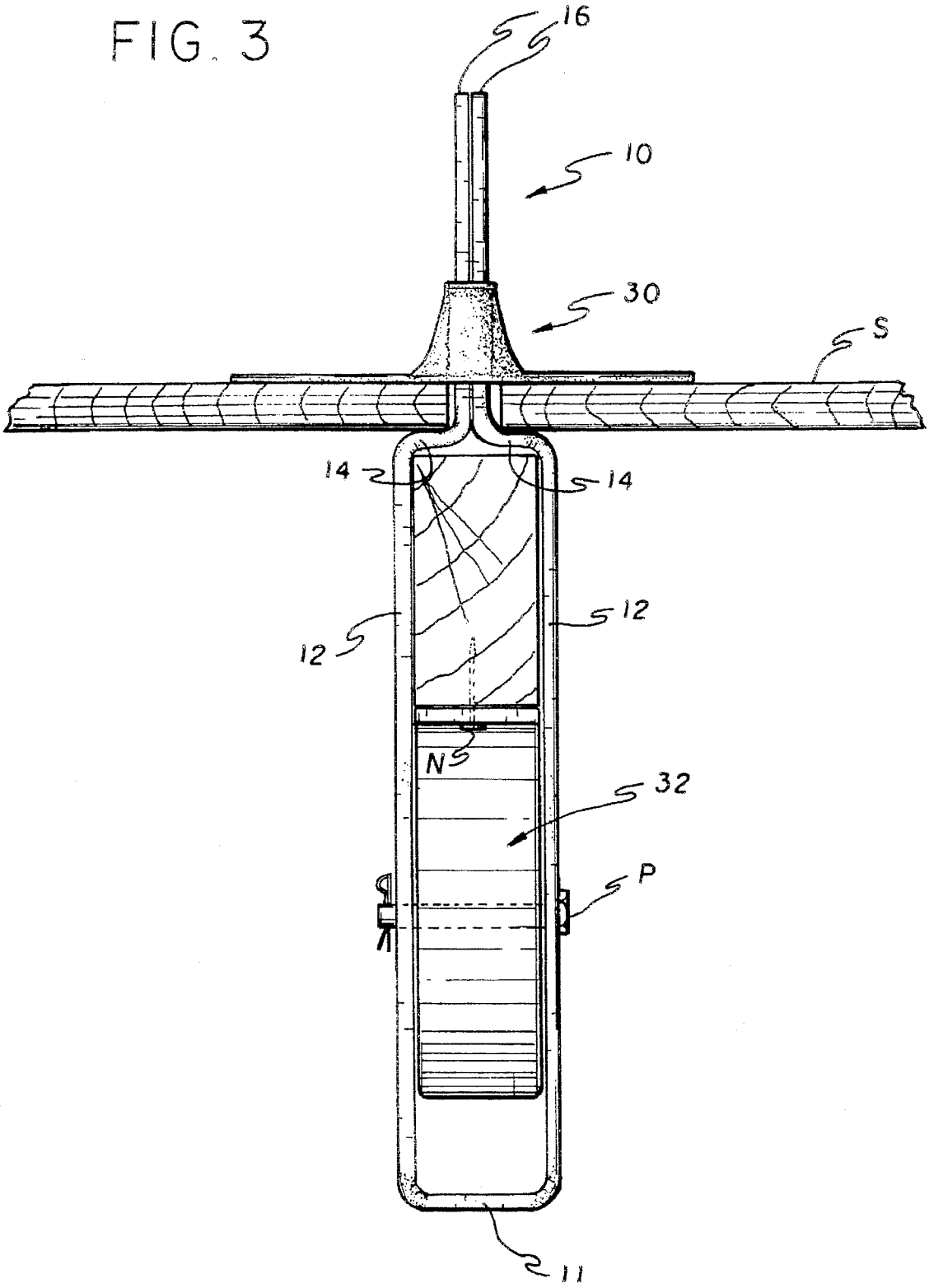
FIG. 3 is an end elevational view of the anchor and flashing, installed on a roof rafter by a wedge, and roof sheathing.
Figure 4:
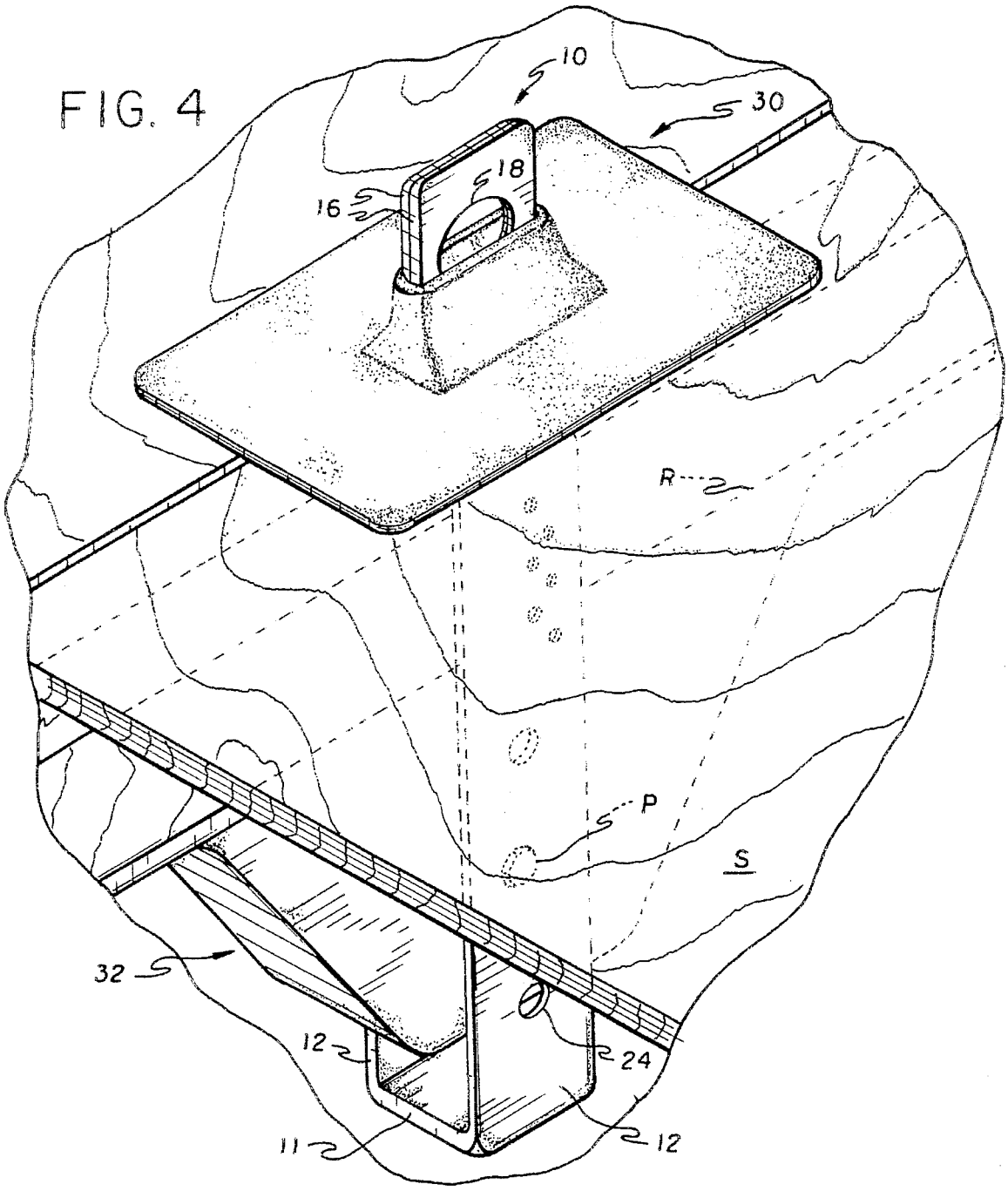
FIG. 4 is a perspective view of the anchor and flashing, installed on a roof rafter, with a wedge, and roof sheathing.

FIGS. 3 and 4 show a flashing 30 and sheathing S installed over the anchor 10. In FIG. 3, sheathing S is shown installed over the shoulders 14 of the anchor, abutting the tab portion of the anchor 10. A preformed elastomeric flashing 30 is shown applied to the surface of the sheathing S and sealingly engaged with the surface of the tab portion of the anchor 10. FIGS. 3 and 4 represent a cross-sectional and perspective view of the installation of the anchor and wedge assembly as shown in FIG. 2, onto a rafter R.

Figure 5:
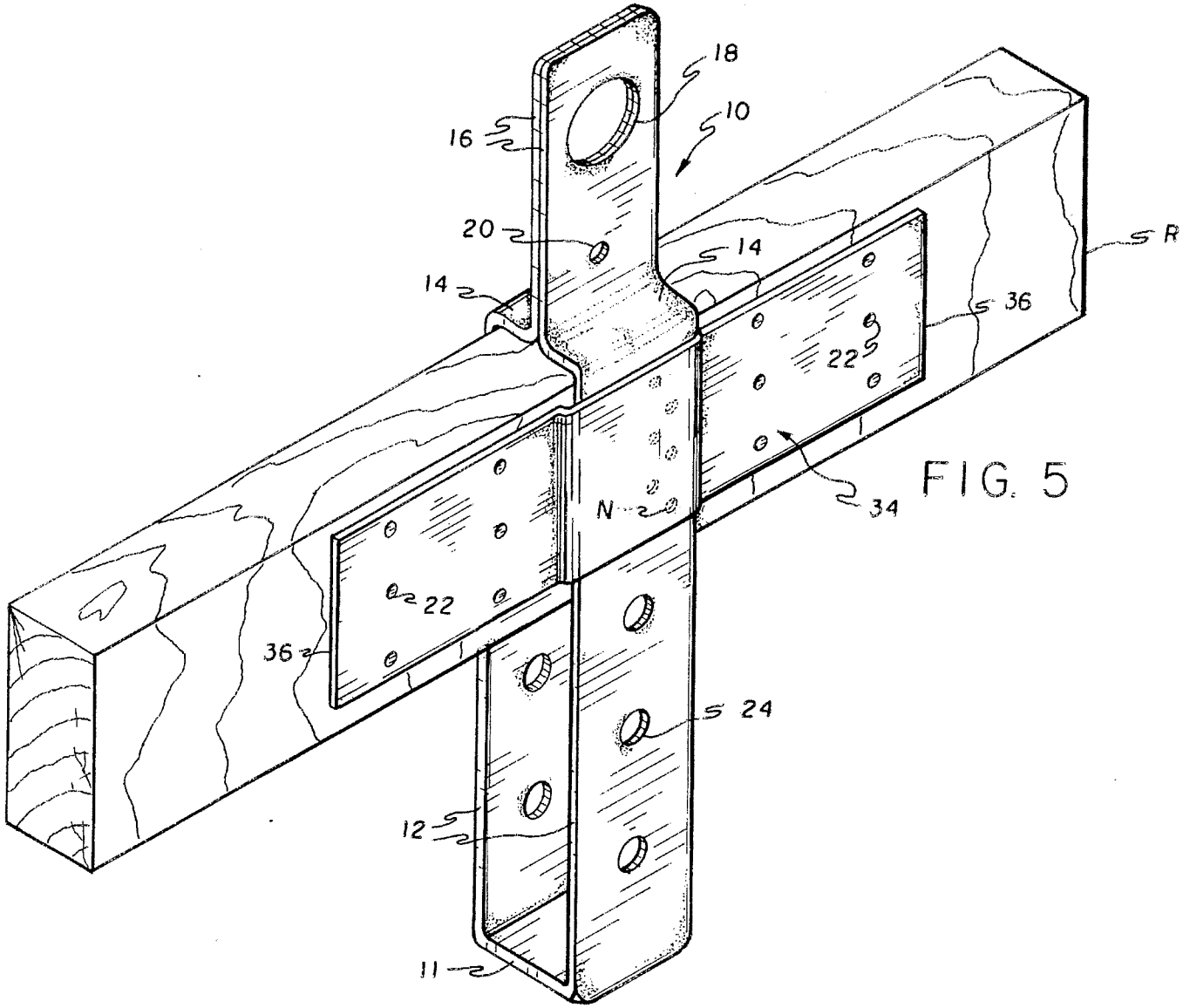
FIG. 5 is a perspective view of the anchor installed on a roof rafter secured by an overlapping plate.

FIG. 5 shows the anchor 10 installed onto a rafter R with an overlapping metal plate 34. The overlapping plate 34 has extending members 36 through which a group of tacking apertures 22 are shown for fastening the overlapping plate 34 to the rafter R. The extending members 36 abut the vertical member 12 and limit movement of the anchor in a direction parallel to the rafter. The overlapping plate 34 further covers fasteners N passing through the tacking apertures 24 found in the vertical member 12.

Figure 6:
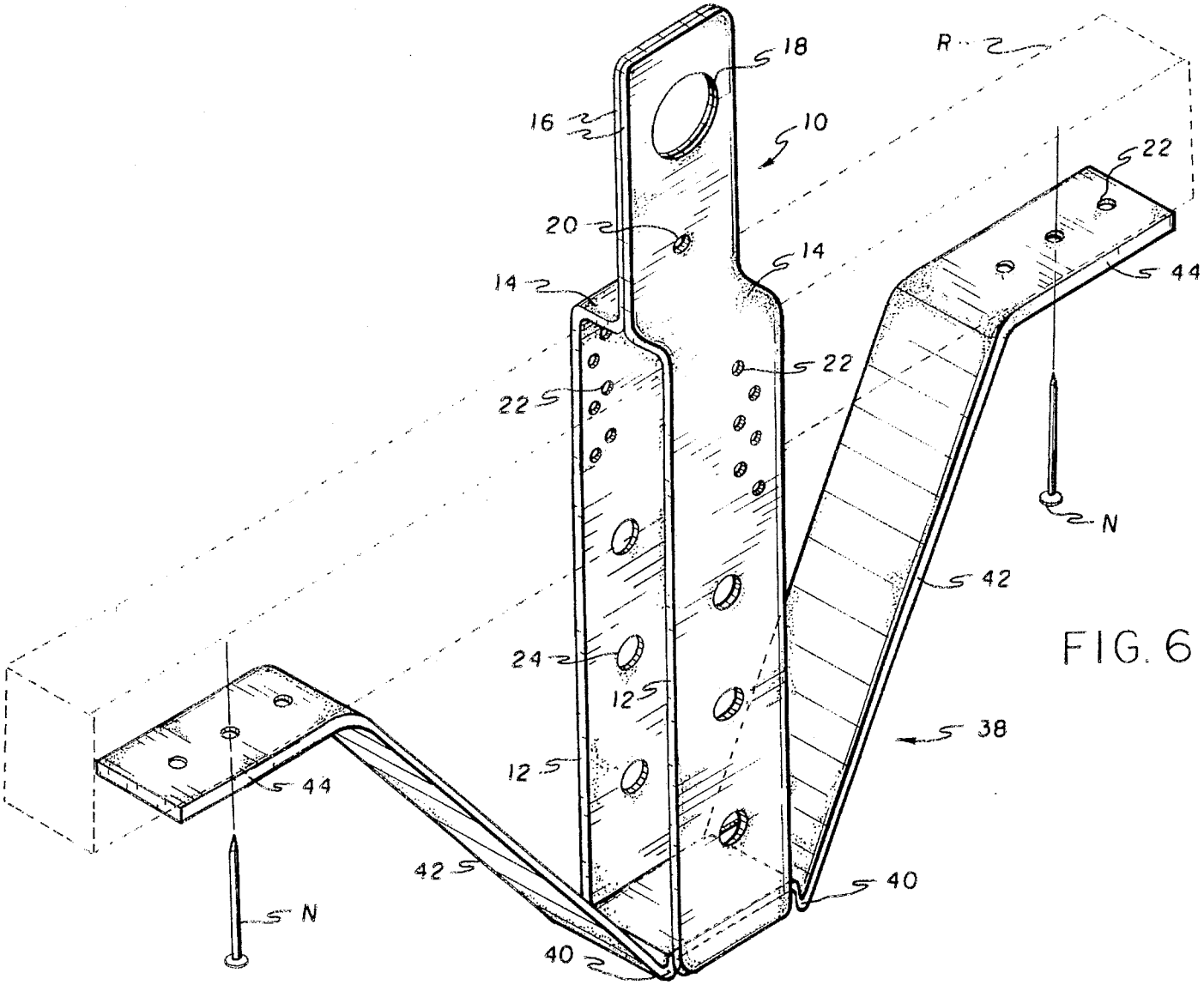
FIG. 6 is a perspective view of the anchor with brace.

Referring now to FIG. 6, a preferred embodiment of a bracing member 38 is shown. The bracing member 38 is shaped so as to engage the bridging member by a pair of flanging members 40. Struts 44 interconnect the flanging members 40 to connecting plates 42 which are fastened to the bottom of a rafter R by fasteners passing through a group of tacking apertures 22.

It is to be understood that the present invention is not limited to the embodiments described above, but encompasses any and all embodiments within the scope of the following claims.

I claim:

1. A lifeline roof anchor comprising:

a unitary, rafter encircling, rigid member, said member including a hoop portion for encircling a rafter, and a tab portion extending upwardly from said hoop portion, said tab portion having means defining an aperture for connection of a safety lifeline, and a mounting means for securing the roof anchor to the rafter, said mounting means including a rigid, continuous, bracing member formed with two ends, said bracing member having a bend at each of a pair of points equidistant from the center of said bracing member, said bracing member running perpendicularly downward to form a pair of flanging members which interlock with the lower portion of said hoop portion, there further being a return bend on each of said flanging members at an upward acute angle to form a pair of struts, there being a bend on each of said struts forming a pair of contact members, said contact members each having means defining at least one tacking aperture for passage of a fastener therethrough.

2. A lifeline roof anchor according to claim 1, wherein said hoop portion includes vertical members, each vertical member having an upper and a lower end; said hoop portion further including a bridging web interconnecting the lower ends of the vertical members said vertical members each further including a shoulder located between said upper ends of the vertical members; and said tab portion including a pair of upwardly extending parallel members, each of said parallel members extending perpendicularly from each said shoulder.

3. A lifeline roof anchor according to claim 1, wherein said tab portion includes means defining openings therethrough for insertion of a fastener.

4. A lifeline roof anchor according to claim 2, wherein each of said vertical members have at least one mounting aperture located at a point spaced from the upper end of each vertical member.

5. A lifeline roof anchor according to claim 2, wherein said vertical members of said hoop portion include at least one tacking aperture located at a point no farther than 3.5 inches from the upper end of each vertical member.

6. A lifeline roof anchor according to claim 2, wherein said vertical members of said hoop portion have offset tacking apertures.

7. A lifeline roof anchor according to claim 1, further comprising preformed flashing installed over the tab portion.

8. A lifeline roof anchor according to claim 7, wherein the flashing is fabricated from an elastomeric material and further includes a frusto-pyramidal apertured member sealingly engaging the surface of the tab portion.

9. A lifeline roof anchor comprising:

a unitary, rafter encircling, rigid member, said member including a hoop portion for encircling a rafter, and a tab portion extending upwardly from said hoop portion, said tab portion having means defining an aperture for connection of a safety lifeline, and a mounting means for securing the roof anchor to the rafter, said mounting means including a wedging member, said wedging member being dimensioned and configured to fit within said hoop portion, said wedging member further including a rafter contacting surface, there further being a pair of extensions extending beyond each end of said wedging member, each said extension having means defining at least one tacking aperture for passage of a fastener therethrough.

10. A lifeline roof anchor comprising:

a unitary, rafter encircling, rigid member, said member including a hoop portion for encircling a rafter, said hoop portion including vertical members, each vertical member having an upper and a lower end, and a bridging web interconnecting the lower ends of said vertical members, said vertical members each further including a shoulder located between said upper ends of said vertical members, and a tab portion extending upwardly from said hoop portion, said tab portion having means defining an aperture for connection of a safety lifeline and including a pair of upwardly extending parallel members extending perpendicularly from each said shoulder, and a mounting means for securing the roof anchor to the rafter, said mounting means includes a preformed overlapping member across said vertical members.

11. A lifeline roof anchor according to claim 10, wherein the overlapping member is a rectangular metal plate, shaped to lie contiguously against a surface of a rafter while conforming to the thickness of said vertical member which said metal plate overlaps, said plate having opposed ends extending beyond each side of said vertical member, and including means defining at least one tacking aperture for passage of a fastener therethrough.

* * * * *